US005573289A

United States Patent [19]

Littlefair

[11] Patent Number: 5,573,289

[45] Date of Patent: Nov. 12, 1996

[54] ENTRY WAY SECURITY CHAIN

[76] Inventor: Lawrence L. Littlefair, 2906 S. 1175 East, Hagerman, Id. 83332

[21] Appl. No.: 523,036

[22] Filed: Sep. 1, 1995

[51] Int. Cl.[6] ..... E05C 17/36

[52] U.S. Cl. ..... 292/264; 292/259 R

[58] Field of Search ..... 292/264, 259 R

[56] References Cited

U.S. PATENT DOCUMENTS

| | | | |
|---|---|---|---|
| 482,227 | 9/1892 | Conner | 292/264 |
| 977,316 | 11/1910 | Kohn . | |
| 2,628,397 | 2/1953 | Olson | 24/68 |
| 3,473,598 | 10/1969 | Winter et al. | 160/328 |
| 4,564,230 | 1/1986 | Haist | 292/218 |
| 4,974,889 | 12/1990 | North | 292/259 R |

FOREIGN PATENT DOCUMENTS

| | | | |
|---|---|---|---|
| 21541 | 7/1929 | Australia | 292/264 |
| 2114206 | 8/1983 | United Kingdom | 292/264 |

*Primary Examiner*—Rodney M. Lindsey
*Attorney, Agent, or Firm*—Frank J. Dykas

[57] ABSTRACT

A security means for a door or other passageway to allow the user the option of reducing tension on the securing means to open the door or other passageway slightly while still providing security by the use of a passageway security system comprising a chain or length of cable consisting of a fixture formed to accept a chain link or a loop formed at the end of a cable to accept means for securing the anchor to the door frame.

1 Claim, 2 Drawing Sheets

ENTRY WAY SECURITY CHAIN

BACKGROUND OF THE INVENTION

1. Technical Field

The present invention relates generally to security devices for entry ways, and more particularly to a security chain which spans a doorway for limiting inward motion of the door.

2. Background

Most doors or other entry ways are typically secured with a hand set or a combination of a hand set and lock set which allows the door to be latched when closed or, in the alternative, to be both latched and locked when closed. The disadvantage of this arrangement is that an occupant, in order to ascertain the identity of an individual or party on the other side of the door, typically unlocks and/or unlatches the door and opens the door partially at which point the door is entirely unrestrained from further opening, other than the physical restraint which the occupant may be able to apply against the door. Additionally, when the sole means of securing the door consists simply of either a hand set, lock set or a combination of the two, effectively there is a single point which restrains forced entry; namely, the point at which the latch or the bolt on the lock penetrates the door frame.

A variety of door security devices are well known. Most notably common and most often seen is the keeper which consists of a short chain typically six to ten inches long, having a first end attached to the door and a second end which may be removably attached to a keeper fixture of some sort permanently attached to the door frame or door jamb. While this arrangement is inexpensive and simple to install, it provides little security, simply because the door which is either open to view through while restrained by the chain, or a door which is locked or latched, once the latch or lock is broken, the door is free to travel the six to ten inches which corresponds to the length of the chain before the security system offers any further restraint. In that distance alone, a door, if adequately forced, can easily tear the chain from its anchorings either at the door frame or on the face of the door.

Kohn, U.S. Pat. No. 977,316, describes and claims a door securing device comprising a door securing bar, an abutment on the floor against which the lower end of the bar is set, with a locking slide-in plate which is mounted on the door having a keeper through which the second end of the bar passes. The second or top end of the bar is secured by a locking slide which, when in the locked position, holds the second end of the bar securely against the door restraining forced entry and which, when in the open or unlocked position, allows entry. Unlike the present invention, Kohn does not allow a door to be partially opened while still providing security or restraint.

Other means for clamping and securing openings have been described and/or claimed. In Winter, U.S. Pat. No. 3,473,598, an improved gate fastener is described.

Olson, U.S. Pat. No. 2,628,397, describes and claims a hold-down clamp for attachment to the body of a truck or trailer which provides a means for holding a load placed on the truck or trailer snugly in contact with the bed of the truck.

Haist, U.S. Pat. No. 4,564,230, describes a restraint apparatus for a cargo box having a pair of doors. The restraining apparatus consists essentially of a leash having means for attachment at either end, the first end attached to the first door latching means and the second end connected to the second door latching means. This restraint apparatus is configured so that in the event a portion of the load contained within the cargo box has fallen against the inside of the door, the door will be restrained from swinging open uncontrolled.

None of the described devices provide the advantages of the present invention, namely, providing a security means for a door or entry way which is secured to the frame on either side of the door, thereby providing a more substantial anchor, together with the feature which allows the user to adjust the tension across the security device, allowing the door to be opened slightly, together with the feature which allows the retaining device to be clamped tightly across the face of the door, effectively providing two additional points of restraint.

DISCLOSURE OF INVENTION

Accordingly, it is an object of the present invention to provide security means for a door or other passageway which is simple to install, which will allow the user the option of reducing the tension on the securing means in order to open the door or other passageway slightly to ascertain the presence or identity of an individual on the other side of the door or passageway while still providing substantial security. These objects are achieved by the use of passageway security system comprising a chain or length of cable of a predetermined length, having means at either end of its length for attachment to an anchoring means located on either side of the door bolted to the frame. These anchor means, in the preferred embodiment, consist of a fixture which is formed in the manner to accept a chain link or a loop formed at the end of a cable having means also formed within the fixture to accept means for securing the anchor to the door frame. In the preferred embodiment, this means comprises a pair of lag bolts. Attached to one of the anchor means is a means for detachably securing the chain which also provides means for tensioning the chain across the door or other passageway. In the preferred embodiment, this means for tensioning comprises a clevis hook swivel.

BEST MODE FOR CARRYING OUT INVENTION

Figure 1:
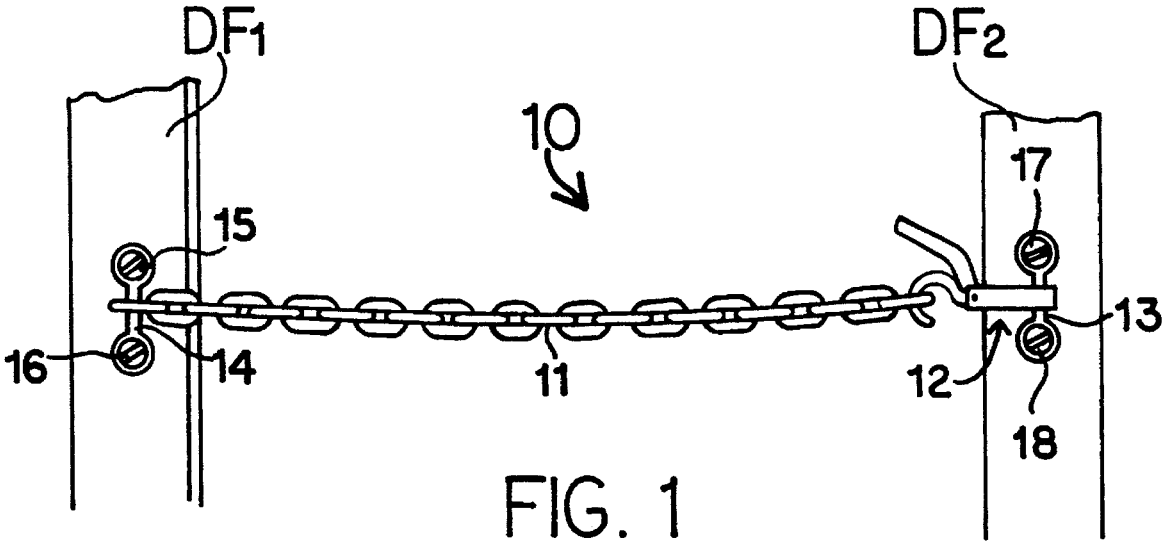
FIG. 1 is a front view of the doorway security chain.
Figure 2:
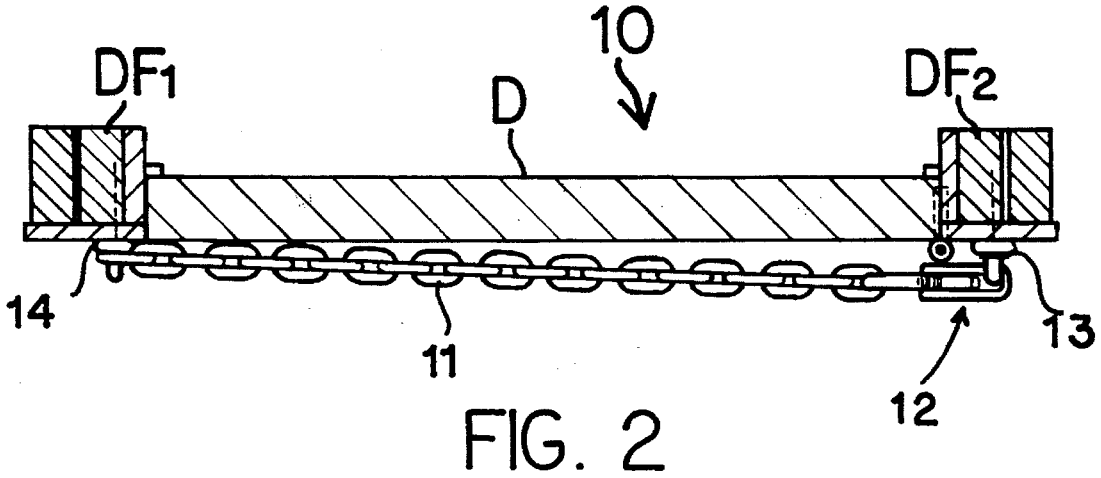
FIG. 2 is a top view of the doorway security chain.

Referring now to FIGS. 1 through 4, the doorway security chain is shown to advantage. In the preferred embodiment, doorway security chain 10 consists of chain section 11 which is anchored at its first end to the first side of the door frame $DF_1$ by anchor means 14. Anchor means 14 is secured directly to door frame $DF_1$ by means of lag bolts 15 and 16. The second end of chain section 11 engages clevis hook swivel 12 which is similarly anchored to the second side door frame $DF_2$. Clevis hook swivel 12 is anchored at anchor 13, which in turn is secured to door frame $DF_2$ by lag bolts 17 and 18.

Figure 3:
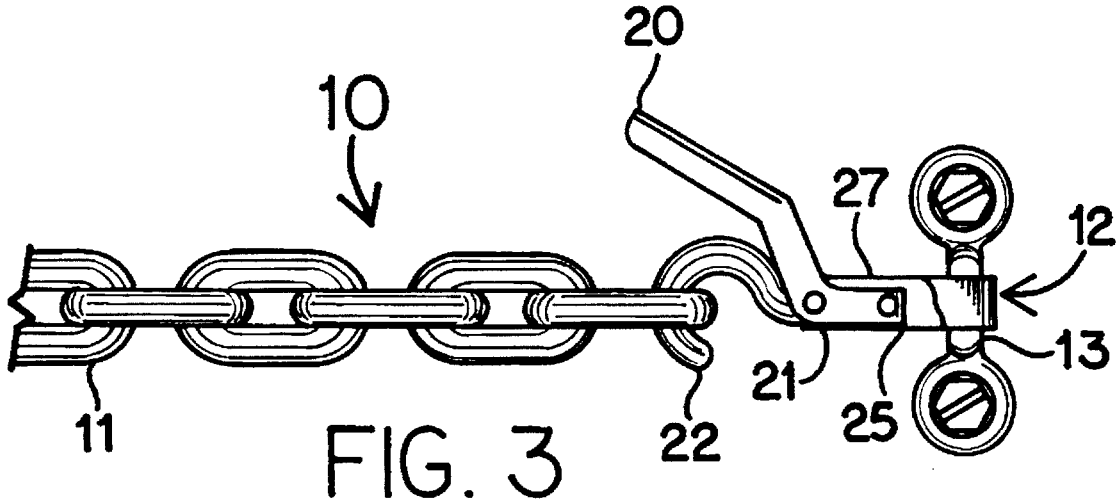
FIG. 3 is a front: view cut-away detail showing operation of the entry way security chain clevis hook swivel component.
Figure 4:
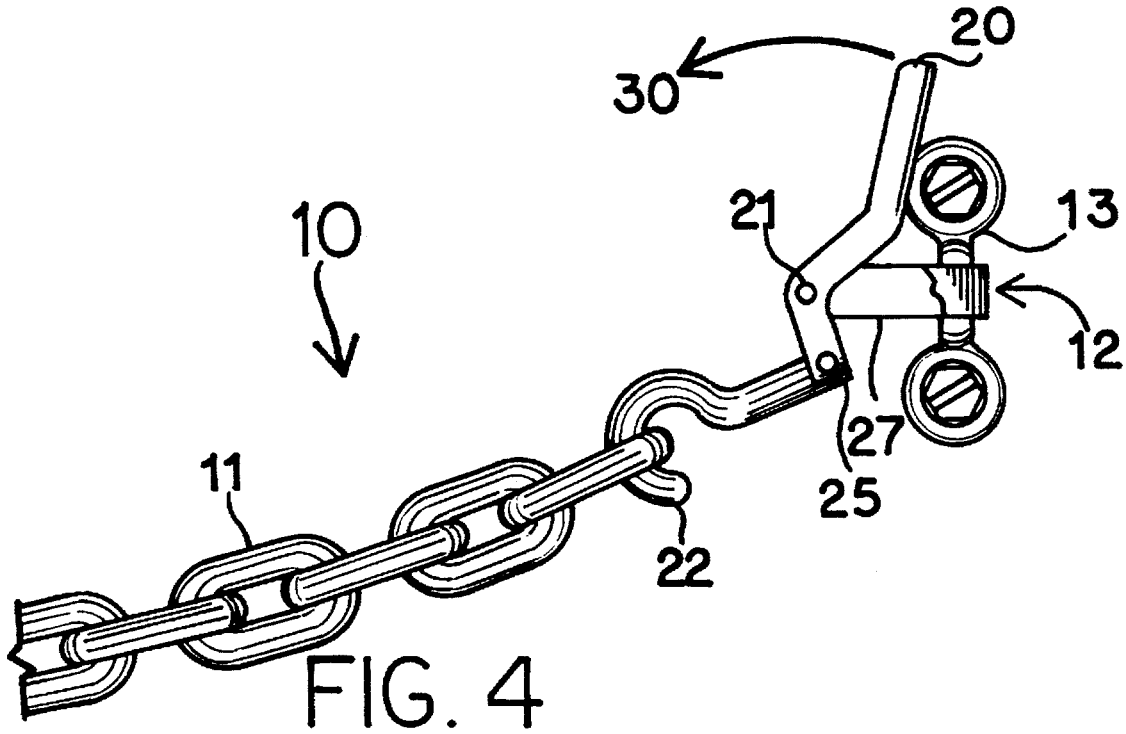
FIG. 4 is a front view cut away detail showing operation of the entry way security chain clevis hook swivel component.

Referring to FIGS. 3 and 4, operation of clevis hook swivel 12 is shown more fully. FIG. 3 depicts doorway security chain 10 in a fully employed position, wherein chain section 11 is attached to hook section 22 of clevis hook swivel 12 and tension is applied to hook section 11 by clevis hook swivel 12.

FIG. 4 depicts doorway security chain 10 wherein clevis hook swivel 12 has been operated in such a manner as to release the tension on chain section 11. Chain section 11 is still engaged with clevis hook 22, which in turn is pivotally connected at pin 25 to lever 20. Lever 20 is in turn pivotally connected to frame 27 of clevis hook swivel 12 by means of pin 21.

In operation, a link of chain section 11 is engaged with clevis hook 22 while clevis hook swivel 12 is in an open position as shown in FIG. 4. Forces 30 exerted on handle 20 which causes handle 20 to pivot on pin 21 which pulls chain section 11 taut as shown in FIG. 3.

While there is shown and described the present preferred embodiment of the invention, it is to be distinctly understood that this invention is not limited thereto but may be variously embodied to practice within the scope of the following claims.

I claim:

1. A doorway security system for attachment to and across a door frame comprising:

a section of chain having links and first and second ends;

a fitting adapted to pass through a link of the section of chain having anchor means for anchoring said fitting to a first side element of a door frame;

a clevis hook swivel having a body segment and a hook pivotally connected to said body segment for connectively engaging and tensioning the section of chain; and a fitting adapted to pass through the body segment of the clevis hook swivel having anchor means for anchoring said fitting to a second side element of a door frame.

* * * * *